United States Patent [19]

Skulic

[11] Patent Number: 5,057,657

[45] Date of Patent: Oct. 15, 1991

[54] ELECTRICAL SWITCH ACTUATOR MECHANISM

[76] Inventor: Vedran Skulic, 7056 N. Monon, Chicago, Ill. 60646

[21] Appl. No.: 556,328

[22] Filed: Jul. 23, 1990

[51] Int. Cl.[5] ..... H01H 13/30

[52] U.S. Cl. ..... 200/517; 200/342; 200/521

[58] Field of Search ..... 200/517, 521, 342, 408, 200/534, 5 A

[56] References Cited

U.S. PATENT DOCUMENTS

| | | | |
|---|---|---|---|
| 4,479,040 | 10/1984 | Denley et al. | 200/517 |
| 4,528,431 | 7/1985 | Coleman, III | 200/408 |
| 4,939,327 | 7/1990 | Wu et al. | 200/517 |

*Primary Examiner*—Renee S. Luebke

*Attorney, Agent, or Firm*—Hill, Van Santen, Steadman & Simpson

[57] ABSTRACT

A low profile keyboard switch actuator mechanism having tactile and/or audible feel, for use in combination with a membrane switch assembly, and which includes a housing for mounting on top of the membrane switch assembly, a plunger slidably positioned in the housing, an actuator pivotally mounted within the housing, and a biasing spring. The actuator has a vertical arm and a horizontal leg. A slide member is mounted on the arm. Upper and lower stops on the arm limit the range of movement of the slide member. The spring is seated upon the horizontal leg and urges the plunger outwardly in an upper opening in the housing. Cooperating cam surfaces on the plunger and the slide member function during reciprocating movements of the plunger for attaining desired sensible results with mechanism.

17 Claims, 3 Drawing Sheets

ELECTRICAL SWITCH ACTUATOR MECHANISM

BACKGROUND OF THE INVENTION

This invention relates generally to switch actuator mechanisms and more particularly, it relates to an improved electrical switch actuator mechanism which provides tactile and/or audible feedback to a user. The present invention has particular applications for use in keyboard assemblies having multiple key-switches to signal utilization electronic devices such as Laptop personal computers, typewriters, pocket calculators, telephones and the like.

Generally, there are known to exist in the prior art various manually activated switching apparatus for engaging electrical contacts to complete an electrical conduction path. Some of the prior art designs utilize a compression column spring in conjunction with a rocker actuator. For example, in U.S. Pat. No. 4,118,611 issued on Oct. 3, 1978, to Richard H. Harris, there is shown and described a pivoting switch actuator using a buckling compression spring to move the actuator in response to depressions of a key in which the actuator causes closing and opening of a switch through changing the capacitance between contacts with which the actuator cooperates.

Also, there is taught in U.S. Pat. No. 4,528,431 issued on July 9, 1985, to Edwin T. Coleman III, a buckling spring which extends between a key and a pivoting rocking actuator for causing closure of the contact switch of a membrane contact switch assembly when the key is depressed. In particular, the pivoting rocking actuator has a first bottom surface, which comprises two spaced portions, resting on an upper surface of the membrane contact switch assembly when the actuator is in its rest position. When the key is depressed, the spring buckles in a selected direction to cause initial pivoting of the actuator about a forward edge of each of the spaced portions. This causes a curved bottom surface of the actuator to rotate about a pivot point on the bottom curved surface so as to close the contact switch. When the key is released, the spring unbuckles at a slower rate than its compression so that the actuator initially further rotates in the same direction in which it is rotated during depression of the key prior to rotation in the opposite direction to return the actuator to its initial rest position.

In U.S. Pat. No. 4,479,040 issued on Oct. 23, 1984, to Ronald S. Denley et al., there is disclosed a switch having tactile feedback which includes a housing, a set of electrical contacts, a reciprocative plunger, an actuator, and a coupler. A first spring is located between the plunger and the actuator for biasing them apart. The coupler includes a blocking tang which engages the actuator during a first portion of the plunger stroke to prevent movement of the actuator. A second spring is located between the coupler and the housing to bias the coupler upwardly. After a predetermined amount of plunger travel, a trip mechanism separates the coupler from the plunger with the resulting decrease in resistance to the plunger stroke so as to provide the tactile feedback to the operator. Simultaneously, the blocking tang disengages the actuator so that the first spring is able to cause the actuator to close the switch contacts.

Still other prior art key-switch actuator designs utilize a dome-type actuator made of silicone rubber for opening and closing switch contacts to provide for electrical connection. A search conducted by applicant and directed to the subject matter of this application uncovered the following additional patents: U.S. Pat. Nos. 4,002,871; 4,123,627; 4,245,138; 4,433,224; 4,405,845; and 4,528,428. However, these latter patents are considered to be only of general interest.

Therefore, these prior art switch actuator mechanisms have a significant drawback in that the materials used in manufacturing the buckling springs and the rubber dome-type actuators have inherent problems in reliability and in quality control. Specifically, during mass production it is difficult and costly to maintain these parts within the required tolerance necessary for proper switch operation. Further, it has been encountered that the prior art switch actuator mechanisms utilizing a buckling spring have corrosion problems in certain environments, thereby limiting its useful life. Additionally, these prior art devices have disadvantages due to the use of a large number of parts and thus resulting in increased manufacturing and assembly costs.

Accordingly, it would be desirable to provide an improved electrical switch actuator mechanism which is more reliable and accurate in operation and can be manufactured more economically without the need of high tolerances as required in the prior art. Further, it would be expedient to provide an improved electrical switch actuator mechanism which is constructed of a relatively few number of components so as to facilitate easy and quick assembly.

SUMMARY OF THE INVENTION

It is a general object of the present invention to provide an improved electrical switch actuator mechanism which overcomes each and every one of the indicated disadvantages of the prior art devices.

It is a further object of the present invention to provide an improved electrical switch actuator mechanism which is constructed of a relatively few number of components.

It is another object of the present invention to provide an improved electrical switch actuator mechanism which has a high reliability, has increased longevity, and is economical to manufacture and assemble.

It is still another object of the present invention to provide an improved electrical switch actuator mechanism which includes a plunger having a first cam surface, an actuating member formed of a vertical section and a horizontal section, a slide member disposed slidably between the vertical section and the plunger, and a second cam surface, located on the slide member, for cooperative contact engagement with the first cam surface.

In accordance with these aims and objectives, the present invention is concerned with the provision of a low profile keyboard switch, having tactile and/or audible attributes for use in combination with a digitally operable, membrane switch array which includes a housing mounted on top of a membrane switch structure and having an upward opening therein, a plunger slidably positioned in the housing, an actuator pivotally mounted within the housing, and a spring member. The actuator has a vertical section and a horizontal section. A slide member is disposed slidably on the vertical section of the actuating member and faces the plunger. Upper and lower stops on the vertical section limit reciprocative movement of the slide member. The spring member is seated upon the horizontal section of the actuating member and urges the plunger outwardly in the opening. Cooperating cam surfaces on the plunger, and the slide member provide a simple and efficient motion and force transfer mechanism.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
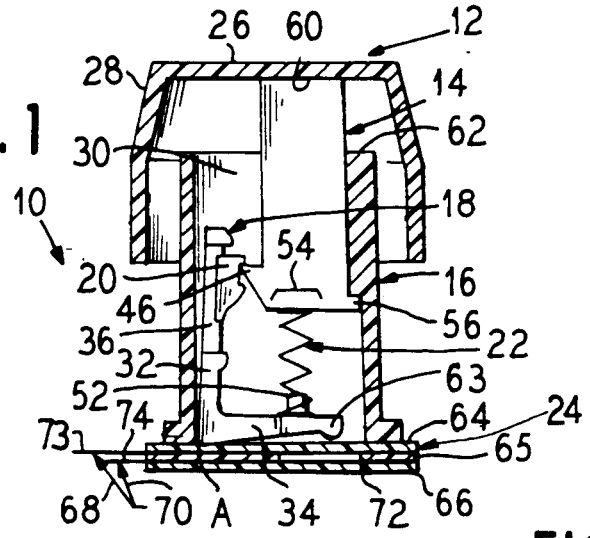
FIG. 1 is a vertical-sectional view of an electrical switch actuator mechanism, constructed in accordance with the principles of the present invention.
Figure 2A:
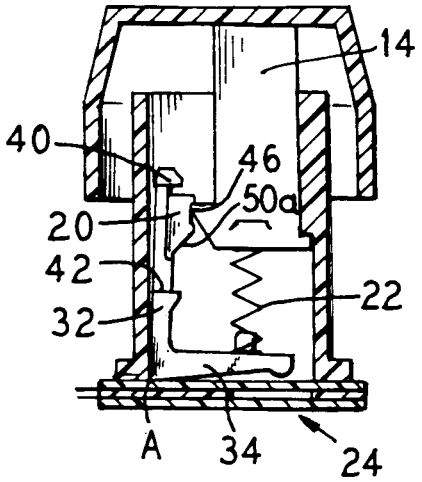
FIGS. 2(*a*), 2(*b*), 2(*c*) and 2(*d*) illustrate a sequence of operations of the switch actuator mechanism of FIG. 1.
Figure 2B:
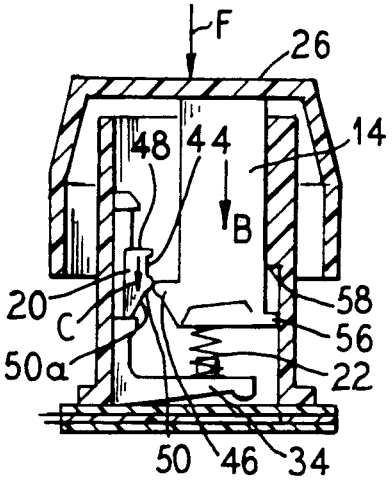
Figure 2C:
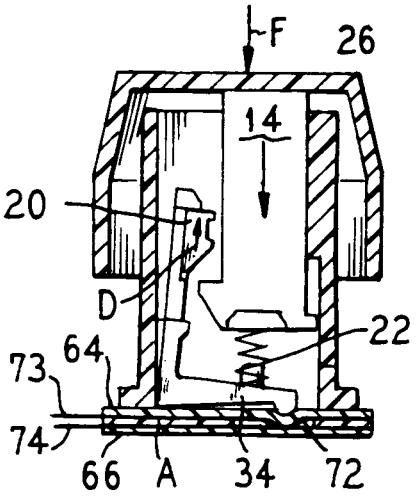
Figure 2D:
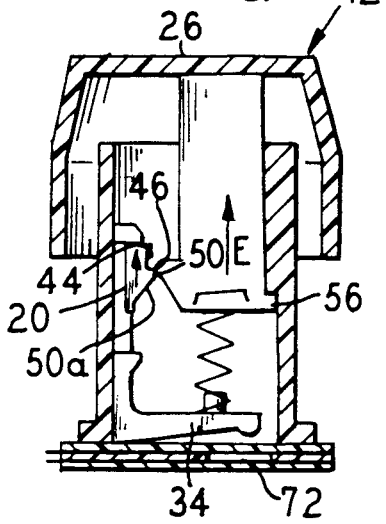

Referring now in detail to the various views of the drawings, there is shown in FIG. 1 an electrical switch actuating mechanism, designated generally by reference numeral 10, which is constructed in accordance with the principles of the present invention, and provides desirable tactile and audible sensibility in operation. The mechanism 10 is comprised of a keycap 12 having an integrally formed plunger 14, an upstanding tubular housing 16, an L-shaped pivoting actuator 18, a slide member 20, and a coil spring 22. The switch actuating mechanism 10 has particular applications in a keyboard of Laptop PC computers and other data processing equipment so as to select a particular one of the characters on the keyboard. Upon depression of the keycap 12 of the switch actuating mechanism 10, the L-shaped actuator 18 will cause activation of a switch structure assembly 24 to provide electrical connection as will be described more fully hereinafter.

The keycap 12, housing 16, actuator 18 and slide member 20 are all preferably constructed of a plastic material which can be manufactured economically by a conventional and simple injection molding process.

Unlike the prior art, the present actuating mechanism 10 utilizes a coil compression spring 22 rather than a buckling compression spring. Since the coil spring 22 is not required to provide critical buckling in order to produce rotational movement of the actuator 18, it can be produced more economically because a high degree of tolerance is not needed in its manufacture. It should be noted that the housing 16 may be mounted to the upper membrane of the switch structure assembly 24 in any number of ways well-known in the art.

The keycap 12 is formed with a flat top crown portion 26 and a downwardly extending skirt 28. In substantially the median area on the underneath side of the top crown portion 26, there is formed integrally therewith the downwardly extending vertical plunger 14. The housing 16 has a hollow interior chamber 30 for receiving slidably reciprocatingly therein the vertical plunger 14. The L-shaped actuating member 18 is also located in the interior chamber 30 and has a vertical section or arm 32 and a horizontal section or leg 34. The arm 32 includes an elongated dovetail track guide portion 36 (FIG. 5(*a*)) which is adapted to slidably engage within a complementary dovetail groove 38 formed on the outwardly facing or backside of the slide 20. An upper stop means projection 40 is formed adjacent the uppermost part of the track portion 36 for limiting upward extent of travel of the slide 20. A lower stop means projection 42 is formed on the arm 32 at the lowermost end of the track 36, and is spaced from the stop projection 42 a predetermined distance greater than the length of the slide 20, for limiting the downward extent of travel of the slide 20.

The front or inwardly facing side of the slide 20 is formed on its upper area with a recess 44 for receiving a laterally projecting cam boss 46 located on the side of the plunger 14 which confronts the slide 20. The boss 46 is received in the recess 44 between an overhanging stop 48 and a lower rounded cam protuberance 50 formed on the slide 20. The cam protuberance 50 has a downwardly receding inclined cam surface 50A.

The horizontal leg 34 includes an upwardly projecting retaining post 52 disposed on the top surface thereof and aligned with the plunger 14. At its lower end, the coil spring 22 retainingly embraces and grips the retaining post 52. At its upper end, the spring 22 is retainingly engaged in a downwardly opening socket 54 formed in the lower end surface of the plunger 14. With the spring 22 extending between the top surface of the leg 34 and the lower surface end of the plunger 14 in the rest or reset position, the coil spring 22 is maintained under sufficient compression for continuously biasing the plunger and keycap assembly 14/12 and the housing/actuator 16/18 axially apart. Upward movement of the plunger/keycap is limited by an outwardly projecting stop 56 on the lower end of the plunger 14 and facing upwardly for engaging a downwardly facing overhanging stop shoulder 58 on the surface of the wall defining the chamber 30 within the housing 16. Downward movement limit of the plunger/keycap assembly is achieved by stopping engagement of an underneath surface 60 of the keycap crown 26 with an upper end surface 62 of the housing 16.

The horizontal leg 34 has a downwardly extending terminal finger 63 formed on its distal end for activating or closing the membrane switch assembly 24, as will be explained hereinafter.

The switch structure assembly 24 preferably comprises of a membrane contact switch which includes an upper layer 64 of an electrically insulating material, an intermediate layer 65 of an electrically insulating material, and a lower layer 66 of an electrically insulating material. Each of the layers 64–66 is preferably formed of Mylar. The lower surface of the upper insulating layer 64 is provided with an electrically conductive layer 68 such as a metallic film defining a first conductive switch lead. The upper surface of the lower insulating layer 66 is provided with an electrically conductive layer 70 defining a second conductive switch lead. The first and second switch leads 68, 70 provide a contact switch in which the intermediate layer 65 normally separates the first and second conductive layers 68 and 70. Thus, the contact switch 24 is referred to as being normally open.

When the upper layer 64 is flexed downwardly by the arm finger 63 of the actuator 18, the first conductive layer 68 is caused to move downwardly through an opening 72 in the intermediate layer 65 and into engagement with the second conductive layer 70. As a result, the switch contacts will be closed so as to provide for electrical connection between the first and second switch leads 68 and 70. It should be apparent to those skilled in the art that the respective ends 73 and 74 of the switch leads can be suitably connected to various electrical utilization devices which can make use of the closing and opening of the contact switch.

Operation of the switch actuator mechanism 10 will now be described in detail by reference to FIGS. 2(*a*-)-2(*d*) of the drawings. In the initial or reset position of FIG. 2(*a*), which is identical to FIG. 1, it can be seen that the vertical arm 32 of the actuating member 18 is slightly angled away from the inner surface of the housing 16 and the leg is similarly angled upwardly relative to the switch structure 24 so as to enable pivoting, i.e. rocking, of the actuator 18 about a rocker point or fulcrum A on the upper membrane of the switch assembly 24. The biasing spring 22 urges the plunger 14 to its uppermost position so that the slide member 20 is held by the boss 46 to be just below the upper stop 40 of the actuating member arm 32. Further, the downwardly extending projection or finger 63 on the bottom surface of the free end of the horizontal section leg 34 of the actuating member is free from engagement with, i.e. spaced from, the top surface of the upper switch assembly layer 64. As a result, there is no electrical connection between the first and second conductive layers 68 and 70.

In FIG. 2(*b*), there is illustrated the switch actuator mechanism of FIG. 2(*a*) but with a force F applied to the keycap crown 26 so as to depress the plunger 14 from its uppermost position of FIG. 2(*a*). As the plunger moves downwardly in the direction of arrow B, the slide 20 will also move downwardly in the direction of arrow C since the boss 46 of the plunger 14 will be in contact engagement with the low cam protuberance 50 of the slide member 20. The downward extent of travel of the slide member 20 is limited by the lower stop member 42 on the arm 32 of the actuator but continued depressing, i.e. downward movement of the plunger causes the plunger boss 46 to cammingly thrust against the slide protuberance 50 and thereby cause rocking of the actuator 18 so that the arm 32 swings against the adjacent housing chamber wall and the leg 34 swings upwardly toward the plunger 14. This amount of travel of the plunger 14 is sometimes referred to as "pretravel." It will be noted that this action results in a compression of the coil spring 22.

In FIG. 2(*c*), there is illustrated the switch actuator mechanism of FIGS. 2(*a*) and 2(*b*) but with the keycap depressed further to a point at which the boss 46 of the plunger 14 has just moved below or under the cam protuberance 50 of the slide member 20. Then, the upward force vector applied to the slide member 20 in the direction of arrow D by cam action of the boss 46 against the cam surface 50A, and the sudden expansion force of the loaded spring 22 causes the slide member to snap upwardly against the stop 40. Simultaneously, the actuator 18 is caused to rotate clockwise so that the finger 63 snaps down toward and into switch closing thrusting contact with the membrane 64 and closes the contacts of the switch 24 to establish a desired electrical connection. This sudden snapping action involving the actuator 18 and especially the slide member 20 provides tactile feedback to a human operator. There is also provided an audible feedback since the sudden pivoting of the actuating member 18 and the slide member 20 hitting the upper stop member 40 will provide a clicking sound. Continued downward motion of the plunger 14 after the point of closing the contact switch is sometimes referred to as "overtravel." This plunger overtravel is limited by engagement of the shoulder 62 of the housing against the underneath surface 60 of the keycap.

In FIG. 2(*d*), there is illustrated the switch actuating mechanism of FIGS. 2(*a*)-2(*c*), but with the keycap 12 and plunger 14 returned to reset position by virtue of released spring force E. As the plunger arm boss 46 rides up the cam surface 50*a*, it rocks the arm 32 and thereby the leg 34 counterclockwise and causes opening of the switch 24. Riding of the boss 46 past the boss 50 and snapping into the slide recess 44, causes a sensible reaction advising the operator that the switch 24 is open. The switch actuating assembly 10 is now reset for another cycle of operation, and with the top surface of the slide 20, which has engaged the upper stop 40 in FIG. 2(*d*), shifted downwardly to the starting position illustrated in FIG. 2(*a*).

Figure 3:
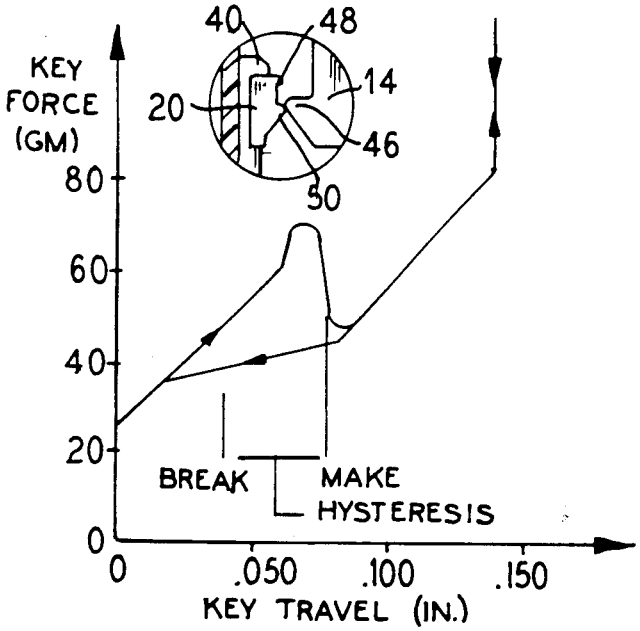
FIG. 3 illustrates the key force and the displacement characteristic of the present switch actuator mechanism as depicted in FIGS. 2(*a*)–2(*d*)
Figure 4:
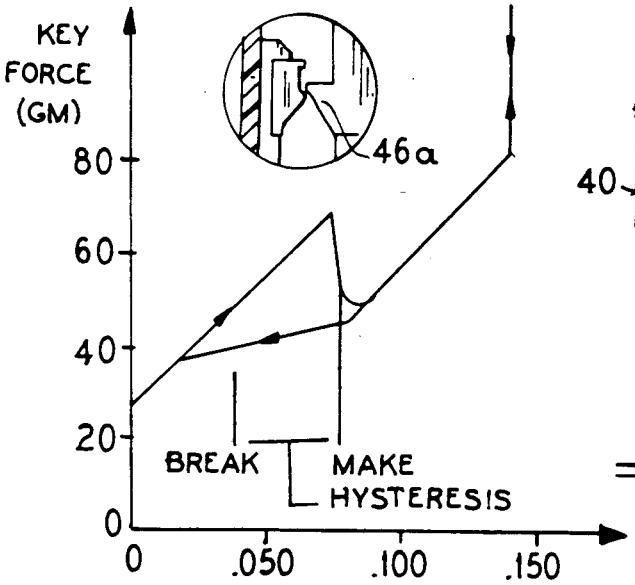
FIG. 4 illustrates the key force and the displacement characteristic of a second embodiment of the present switch actuator mechanism.

Referring now to FIG. 3 of the drawings, there is depicted graphically a keycap force vs. amount of key travel for the switch actuator mechanism of the present invention as previously discussed in FIGS. 2(*a*)-2(*d*). It will be noted that the profiles of the protrusion and boss elements of the slide member 20 and plunger 14 in the small circled area correspond to FIGS. 2(*a*)-2(*d*). The amount of key travel is shown in inches and represents the vertical displacement the keycap experiences due to the applied force F, as given in grams. In FIG. 4, there is shown a force vs. travel graph similar to FIG. 3, but with a different alternate profile for the boss on the plunger as depicted in the small circled area. It is noted that the boss 46*a* in FIG. 4 has a wedge-shape in its cross-sectional area rather than the hooked-shape in its cross-sectional area in FIG. 3.

Figure 5A:
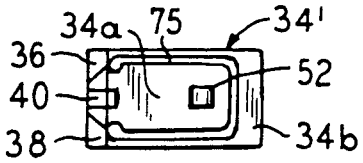
FIGS. 5(*a*), 5(*b*) and 5(*c*) are top, side and bottom views of an alternate embodiment of the actuating member for use in the present switch actuator mechanism.
Figure 5B:
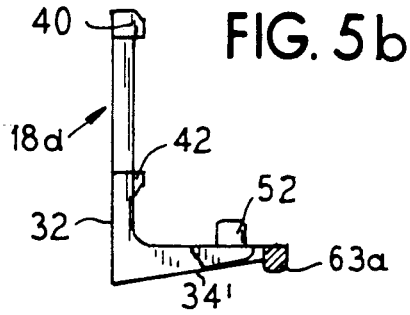
Figure 5C:
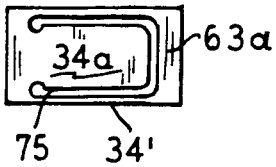

There is shown in FIG. 5(*a*), 5(*b*) and 5(*c*) an alternate embodiment of the pivotal actuator of the present invention. The horizontal section leg 34' of the actuator 18*a* includes a leaf spring structure which has a U-shaped cut-out 75. As a result, the horizontal section 34' is formed with a central part 34*a* cantilevered at its left end to the vertical arm 32 and an outer part 34*b* having a finger 63*a* disposed on its terminal bottom surface for switch closing thrusting toward the membrane contact switch. The central part 34*a* of the leaf spring structure serves to cushion the abrupt force F (FIG. 5(*c*)) applied to the membrane contact switch, thereby prolonging its useful life. The audible feedback will be inherently modified by this design, i.e., the sound will be "softened."

Figure 6:
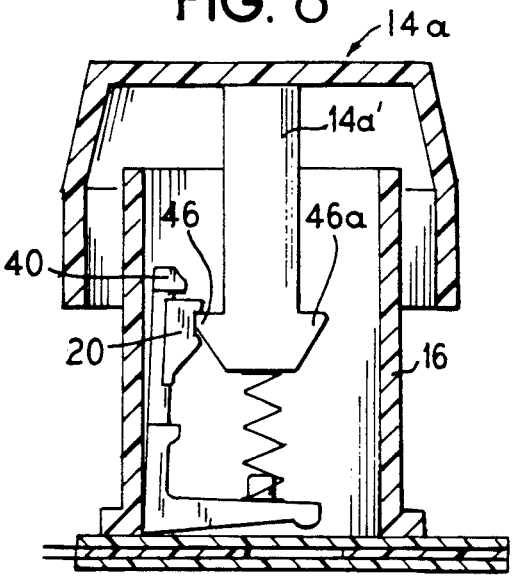
FIG. 6 is a cross-sectional view similar to FIG. 1, but illustrating an alternate embodiment of the plunger.

In FIG. 6, there is shown an alternate embodiment of rectangularly-cross sectioned plunger 14*a* which has two differently shaped bosses 46 and 46*a* on opposite sides thereof. Therefore, this switch actuator mechanism will be capable of providing two different tactile/audible feedbacks by reversing the plunger during the assembly operation. This provides the advantage of being able to select a switch having different tactile/audible characteristics without the need of providing a different plunger part. It should be apparent to those skilled in the art that each of the four sides of the plunger 14*a* could be provided with a boss having different respective profiles.

Figure 7:
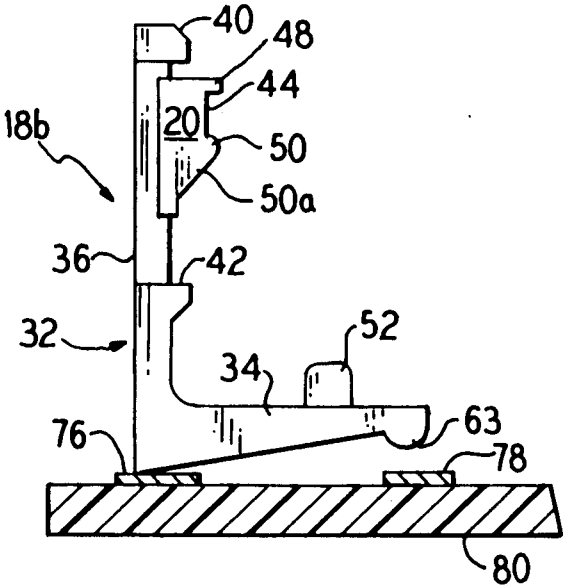
FIG. 7 is a side elevational view similar to FIG. 5(*b*), but with the actuating member being formed of a conductive material and being used directly in conjunction with electrical contacts.

In FIG. 7, there is shown an alternate embodiment, wherein the actuator 18*b* is formed of an electrically conductive material. Further, there are provided metal contacts 76, 78 carried on the surfaces of a printed circuit board 80. As a result, the actuator 18*b* is adapted to make direct electrical connection with the metal contacts.

Figure 8:
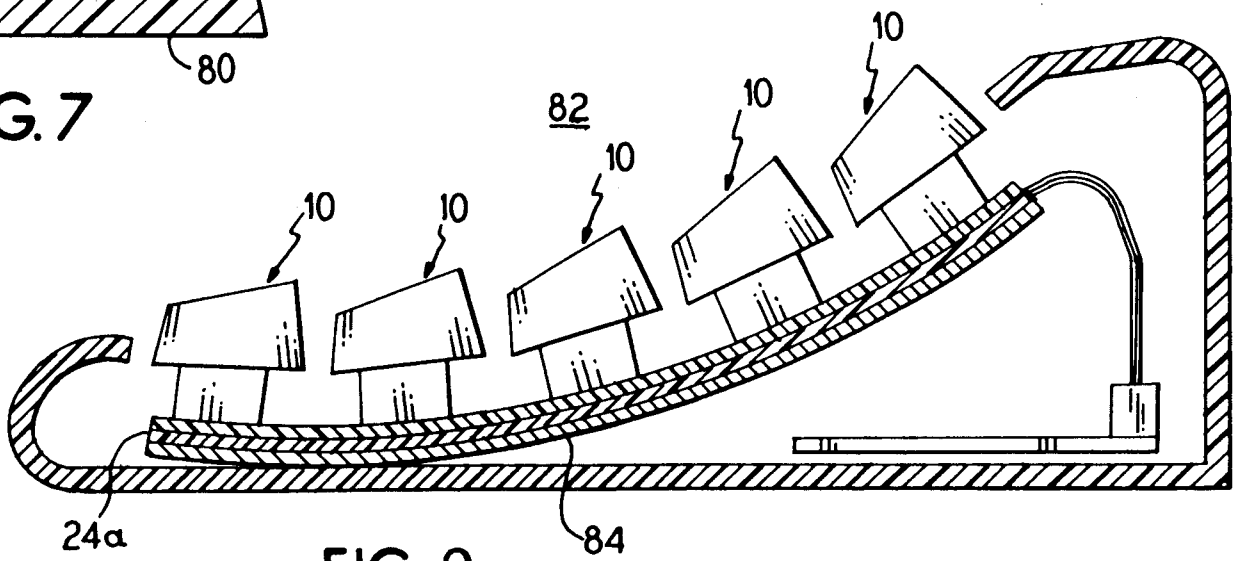
FIG. 8 is a vertical sectional view of a computer keyboard incorporating the switch actuator mechanisms of the present invention.

In FIG. 8, there is shown a computer keyboard 82 which utilizes a plurality of the switch actuator mechanisms 10 of the present invention. As can be seen, each of the switch actuator mechanisms 10 comprises a single unitary assembly and is arranged on top of a membrane contact switch assembly 24*a* which is mounted on a base plate 84.

From the foregoing detailed description, it can thus be seen that the present invention provides an improved electrical switch actuator mechanism which provides tactile and/or audible feedback to a user. The actuator mechanism of the present invention is constructed of a relatively few number of simple components, thereby facilitating its manufacture and assembly.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A low profile keyboard switch having tactile and/or audible feedback in operation and adapted for use in combination with a membrane switch array, comprising:

a housing mounted on top of a membrane switch structure and having an upright opening therein;

a plunger slidably positioned in said housing and having an inner end within said housing and an outer end extending out of said opening;

an actuator pivotally mounted within said housing and having a vertical arm section and a horizontal leg section;

spring means seated upon said horizontal leg section and thrusting against said inner end for urging said outer end of the plunger outwardly in said opening;

stop means for limiting outward movement of said plunger in a rest condition of the switch;

a slide member disposed slidably on said arm section in a space between the arm section and said plunger;

spaced upper and lower stops on said arm section for limiting reciprocating movements of said slide member;

cooperating cam surfaces on said plunger and said slide member preventing spring urged pivoting of said actuator at said rest condition of the switch;

limited inward movement of said plunger compressing said spring means and causing said cooperating cam surfaces to force said slide member to engage said lower stop, and continued inward movement of said plunger then causing disengagement of said cooperating cam surfaces with sensible feedback and freeing of said actuator to pivot under a compression force of said spring means and application of a switch closing force by said horizontal leg section of said actuator to the underlying switch structure, and further sensible feedback; and thereafter outward movement of said plunger by said compressed spring means effecting reengagement of said cooperating cam surfaces on said plunger and said slide member and thrusting of said member toward said upper stop and returning of said actuator pivotally to said rest condition of the switch.

2. A switch as claimed in claim 1, wherein said cooperating cam surfaces on said slide member and said plunger are rounded boss cams.

3. A switch as claimed in claim 1, wherein said plunger is selectively shiftable about its axis and is provided with differently shaped cam surface areas on at least two circumferentially spaced sides so as to provide for different tactile/audible feedback characteristics.

4. A switch as claimed in claim 1, wherein said horizontal leg section of said actuator is formed with a central part and an outer part separated by a cut-out portion, said central part serving to absorb the switch closing force applied to the switch for prolonging its useful life.

5. An electric switch operating assembly, comprising:

a digitally manipulatable plunger having an outer end and an opposite inner end;

means for guiding said plunger reciprocatively;

means for mounting said guide means operatively relative to normally open closable electrical switch contacts;

an actuator having an arm and a leg diverging from a fulcrum;

means for rockably supporting said fulcrum with said leg intervening between said inner end and said electrical contacts, and with said arm directed generally toward said plunger outer end and past said inner end;

biasing means for normally pushing said inner end and said leg apart but being adapted to be placed under increased bias load by force applied thereto through axial movement of said plunger;

an axially movable reaction member carried by said arm and located between said arm and said plunger;

separably cooperating means on said reaction member and said plunger and said arm for normally retaining said actuator against rocking movement on said fulcrum but adapted after a predetermined range of said axial movement of said plunger for separation and thereby releasing of said actuator for biasing means thrust rocking of said actuator on said fulcrum for switch closing swinging action of said leg against said contacts; and said reaction member and said cooperating means being active during said rocking of the actuator for effecting sensible feedback through said plunger.

6. An assembly according to claim 5, wherein said plunger comprises a keycap and said guide means comprises a tubular housing, and stop surfaces on said plunger and said housing cooperate for limiting bias load force movement of said plunger relative to said guide means.

7. An assembly according to claim 5, wherein said guide means comprises a tubular housing having said mounting means at one end and having said outer end of said plunger projecting endwise from the opposite end of said housing.

8. An assembly according to claim 5, wherein said guide means comprises a tubular housing having said guide means.

9. An assembly according to claim 5, wherein said cooperating means on said plunger and said member comprise cooperating cam surfaces.

10. An assembly according to claim 5, wherein said plunger has a cam projection, said member has a recess receptive of said projection, a cam boss on said member projects toward said plunger, and said cam projection and cam boss cooperate in movements of said plunger relative to said arm for effecting reciprocating movements of said member.

11. An assembly according to claim 5, wherein said biasing means comprises a single rectilinear coiled compression spring having one end engaged with said inner end of the plunger, and the opposite end engaged with said leg.

12. An assembly according to claim 11, wherein said leg has a retaining protuberance embraced retainingly by said spring.

13. An assembly according to claim 5, wherein said movable reaction member comprises a slide, and track means on said slide and said arm cooperate for reciprocatively guiding said slide, and spaced stops on said arm limit movements of said slide.

14. An assembly according to claim 13, wherein said cooperating track means comprises a dovetail track on said arm and a dovetail groove on said slide.

15. An electric switch operating assembly, comprising:

a digitally manipulatable plunger having an outer end and an opposite inner end;

means for guiding said plunger reciprocatively;

means for mounting said guide means operatively relative to normally open closable electrical switch contacts;

an actuator having an arm and a leg diverging from a fulcrum;

means for rockably supporting said fulcrum with said leg intervening between said inner end and said electrical contacts, and with said arm directed generally toward said plunger outer end and past said inner end;

biasing means for normally pushing said inner end and said leg apart but being adapted to be placed under increased bias load by force applied thereto through axial movement of said plunger;

an axially movable reaction member associated with said arm and located between said arm and said plunger;

separably cooperating means on said reaction member and said plunger and said arm for normally retaining said actuator against rocking movement on said fulcrum but adapted after a predetermined range of said axial movement of said plunger for separation and thereby releasing of said actuator for biasing means thrust rocking of said actuator on said fulcrum for switch closing swinging action of said leg against said contacts;

said reaction member and said cooperating means being active during said rocking of the actuator for effecting sensible feedback through said plunger;

said cooperating means on said plunger and said member comprising cooperating cam surfaces;

said cam surfaces comprising rounded cam bosses effecting rocking of said arm away from said plunger in one relative position of said plunger and said arm; and a diagonal cam surface leading from the rounded boss cam surface on said reaction member and engageable by the rounded cam surface on the plunger for camming said member in the opposite direction from the direction of movement of said plunger in a portion of said axial movement of the plunger.

16. An assembly according to claim 15, wherein said leg has a finger which drives the switch contacts into closing switch relation when the leg is driven toward said contacts.

17. An assembly according to claim 15, wherein said cam surface on the plunger engages said diagonal surface during spring biased return movement of the plunger and cams the slide member and thereby moves the arm for rocking the actuator to release said leg from the switch contacts.

* * * * *